United States Patent [19]

Brandon et al.

[11] 4,132,592

[45] Jan. 2, 1979

[54] ENTANGLED NON-WOVEN WEB-FORMING APPARATUS

[75] Inventors: Ralph E. Brandon, Lewisburg, Pa.; Michael Ring; James B. Morris, both of Warwick, N.Y.

[73] Assignee: International Paper Company, New York, N.Y.

[21] Appl. No.: 770,690

[22] Filed: Feb. 22, 1977

[51] Int. Cl.[2] ..... D21F 1/02

[52] U.S. Cl. ..... 162/216; 162/272; 162/342

[58] Field of Search ..... 162/216, 341, 342, 199, 162/272

[56] References Cited

U.S. PATENT DOCUMENTS 1,022,778 4/1912 Ellis ..... 162/342 X

FOREIGN PATENT DOCUMENTS 29770 11/1958 Finland ..... 162/341

*Primary Examiner*—Richard V. Fisher

*Attorney, Agent, or Firm*—James D. Bock; Thomas L. Giannetti

[57] ABSTRACT

In an apparatus for forming a non-woven, fibrous web, a device for making a uniform density dispersion of the fibers in an aqueous fiber slurry and depositing the dispersion onto a web former, while maintaining its integrity. The device includes a generally laterally divergent channel, in which the greatest depth of the flowing stream of fiber slurry is at its fiber slurry entry end, having rolls for uniformly dispersing the fibers, rolls for uniformly spreading the dispersion laterally throughout the channel, and means in cooperation with the rolls for moving the dispersion to an exit end of the channel adjacent the web former. Preferably, the device is equipped with air doctors directed at the rolls for insuring the separation of the dispersion from each roll as it is moved to another roll.

8 Claims, 7 Drawing Figures

ENTANGLED NON-WOVEN WEB-FORMING APPARATUS

BACKGROUND OF THE INVENTION

This invention relates to a flow control means useful in an apparatus for forming a non-woven fibrous web. More specifically, the invention relates to a device for forming a uniform density dispersion of fibers from a slurry of fibers and for depositing the dispersion onto a web former.

The control of a stream of fibers, first non-uniformly suspended in an aqueous slurry and then uniformly suspended throughout a dispersion, is of great importance in the manufacture of web-formed non-wovens. The fiber slurry, which is generally confined in a circular conduit, is usually delivered to a means for converting the slurry into a dispersion by a suitable pump. It is then necessary to transform the slurry into a dispersion and deliver the dispersion to the web forming region of the non-wovens manufacturing apparatus in the form of a wide and relatively shallow stream having a generally rectangular cross section, which stream may be under considerable pressure.

It is known that to produce a non-woven web having uniform physical properties, the stream of fibers in a dispersion delivered to the web forming region of the apparatus should be evenly distributed across the web former. This means that the energy of the stream delivered to the web former should be as uniform as possible throughout the stream cross section, and in addition, the entire stream should be maintained in a condition which is as near to steady-state flow as possible. In other words, the stream should be delivered to the web former at a uniform pressure and velocity across the width of the former, and the pressure and velocity relationship should be substantially invariant.

A web former, in the case of a Fourdrinier machine, generally is a continuously travelling, endless wire, having a horizontally extending run through which (by means including capillary action and surface tension) the medium in which the fibers are dispersed is drawn through so as to leave upon the upper surface of the wire a web of fibers.

The need is well understood and accepted in non-wovens manufacture to supply each incremental area of the web former with an equal and uniform distribution of fibers in dispersion, under steady-state flow conditions, in the form of a moving mass of medium and fiber, with each layer thereof moving in the machine direction at the same velocity and under a pressure that allows a delivery velocity substantially equal to the speed of the moving web former. Various flow control means have been suggested and used in an effort to attain these conditions, but none have been altogether satisfactory.

One known flow control means has utilized multiple feeds of individual fiber streams through a head box to the web former by means of small conduits positioned perpendicular to and across the width of the head box and former, the streams normally being piped into the small conduits through a single, large circular conduit. However, in this event each small conduit creates its own currents and turbulences, which does not produce the uniform pressure and velocity in the composite stream that eventually is delivered onto the web former.

Also, in the manufacture of non-wovens, it has been found that long crimped, synthetic fibers cannot be dispersed by methods used for the dispersion of short crimped or straight fibers. The present invention has been found to be particularly useful for forming a dispersion of fibers of 1.5 denier having a length of about 2 inches, whereas the prior art methods and apparatus are generally useful only for dispersion of fibers about a maximum of ½ inch in length. The present invention is particularly useful for forming a dispersion of long crimped fibers in a high viscosity medium and transferring the dispersion as a three-dimensional loosely entangled fiber network to the web former so that it may be formed into a non-woven web. Previously, during the process of transferring such a fiber dispersion to the web former by conventional means, such as the conduits mentioned above, the integrity, i.e. the degree, uniformity, and three-dimensional characteristics, of the dispersion were susceptible to damage.

Thus, an object of this invention is to form a uniform density dispersion of fibers in a slurry and deliver the dispersion intact to a web former.

Another object of this invention is to provide means particularly for uniformly dispersing fibers previously found to be difficult to disperse and for delivering such a dispersion to a web former in a condition where the dispersion maintains its integrity.

Another object of this invention is to accomplish transfer of a fiber dispersion from the means of its dispersion to a web former, so that this transfer is accomplished uniformly across the width of the former.

SUMMARY OF THE INVENTION

The present invention comprehends a flow control means useful in a non-wovens manufacturing apparatus, which means converts a fiber slurry stream of a certain cross-section to a flowing, yet constantly agitated, fiber dispersion stream of another cross-section, allows the attainment of a well and uniformly dispersed fiber/-medium mixture having little, if any, currents that cause unevennesss as it is delivered to the web former, allows a forward velocity of the stream at the point of entry onto the web former that is in better conformation than that provided by other known flow control means, and includes internal agitation means involving the inducement of small organized cross currents to keep the fibers uniformly dispersed, and, therefore, contributes to the desired, uniform web formation.

The flow control means of this invention has particular relation to the control of a flowing stream comprising a non-uniformly dispersed slurry of fibers and is useful for transforming the stream as it is discharged into the entry end of the device from an inflow conduit of one cross section into a relatively shallow, elongated rectangularly-shaped form as it is delivered from the device's exit end with an exact hydraulic balance being attained at all points along the width so as to allow an equal quantity of the stream to be distributed to each unit width of the web former.

The device includes a divergent channel which is essentially a rigid-walled, laterally-diverging structure connected between the pump and the web-forming region of the apparatus for effecting a widening and reduction in depth of the flowing stream. Thereby, a gradual flattening of the round cross-section of the stream and a gradual pinching of its central flat area, so as to preclude a concentration of flow at its center, is accomplished. The channel functions, within a relatively short distance, to transform the stream from the round cross-section to a relatively flat pattern by virtue of this gradual flattening. A mere flattening of the cross-section, and no more, would create a more or less slot-shaped outflow adjacent the inflow to the web former resulting in an obviously heavier flow at the center of the outflow than at its edges.

The conduit into the divergent channel, which delivers the stream of fibers in a slurry, will be suitably dimensioned and shaped so as to establish the flowing stream in a substantially steady-state condition as it enters the channel. Additionally, the section of the channel adjacent the web former will be likewise suitably dimensioned and shaped so as to maintain the flow outwardly from the channel in a steady-state condition as it enters the web-forming region.

The configuration of the channel per se is such that the stream flowing therethrough is maintained in a substantially steady-state flow condition, such that as it is delivered to its exit end, it will possess a more uniform pressure across the entirety of its width and a more uniform velocity throughout its cross-sectional area.

The attainment of more thorough fiber dispersion allows the increasing of the percentage of fibers in suspension, thereby allowing a reduction in the percentage of medium used, which in turn reduces the amount of medium subsequently to be removed, all permitting higher operating speeds, greater production rates, and substantial savings in power used for pumping the dispersion to the web former.

In the divergent channel the flowing stream of fiber/-medium slurry is deepest at the point of the slurry entry and becomes shallower as the channel diverges so as to maintain an essentially constant cross sectional area. Placed in the channel are dispersing rolls and spreading rolls. The dispersing rolls maintain the fiber dispersed in the medium and the spreading rolls spread the dispersion as a three-dimensional network across the width of the channel. At the exit of the channel, the shallow stream of dispersion is deposited directly onto a web former to subsequently be made into a non-woven web.

The dispersing rolls are preferably conventional "Holander" beater rolls backed by either a ribbed bed plate having transverse or "Herringbone" ribs or a smooth bed plate. The clearance between the dispersing rolls and the bed plates are adjustable. The spreading rolls preferably have either transverse bars or divergent spiral wound bars, either of which spread the dispersion to a uniform density across the width of the channel as it approaches the web former.

Also placed in the divergent channel are means, in cooperation with the dispersing and spreading rolls, for moving the dispersion towards the exit end of the channel adjacent the web former. The means most preferred are back falls, each one being placed downstream of a roll to prevent segregation of the fibers and maintain the desired velocity of the dispersion's movement.

Preferably the device of this invention is also provided with means for insuring the separation of the dispersion from one roll as it is moved to another roll. Conventional baffles placed in the divergent channel are equipped with fluid doctors, each fluid doctor utilized being directed at the roll over which it is suspended to "scrape off" whatever dispersion remains on the roll as the roll rotates away from its downstream back fall. Of course, the fluid doctors may direct fluids other than air against the roll, such as the fiber dispersion fluid.

DETAILED DESCRIPTION OF THE PREFERRED EMBODIMENT

Figure 1:
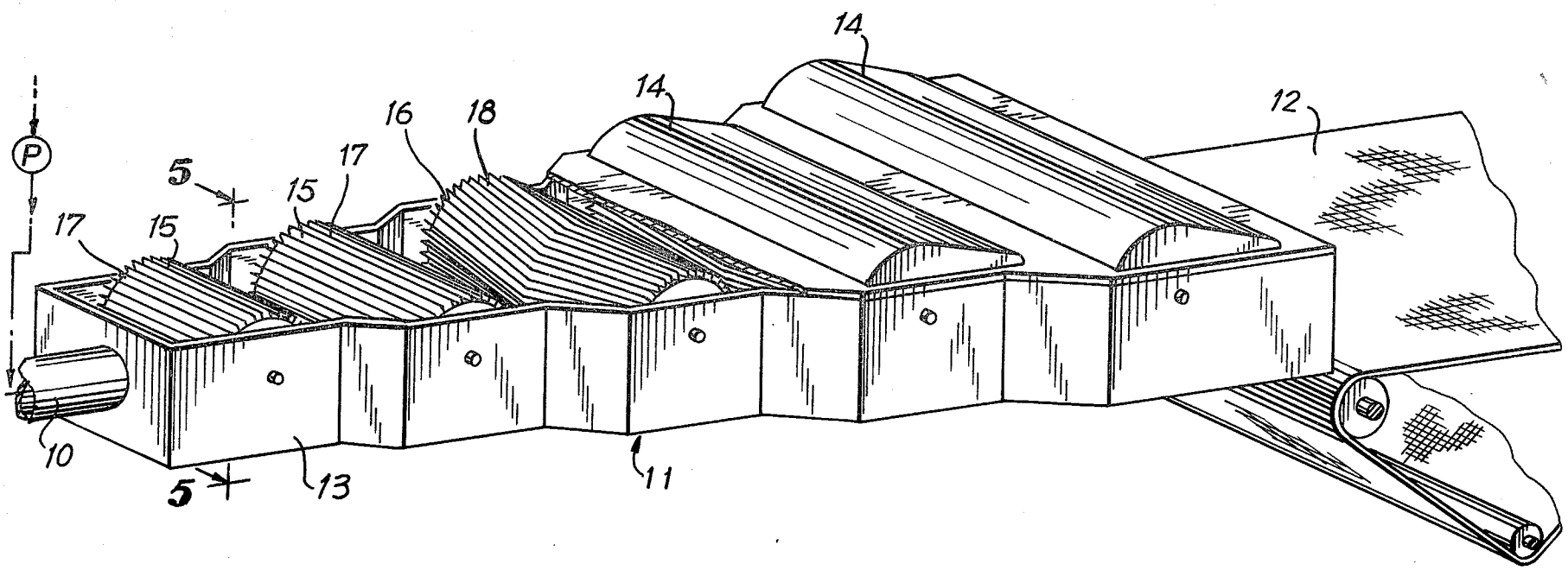
FIG. 1 is a perspective view of the device of the present invention interposed in a non-wovens manufacturing apparatus (partially shown), which view shows the top of the device partially cutaway.

In FIG. 1, an embodiment of the device of the present invention is shown interposed in a non-wovens manufacturing apparatus (partially shown).

By means of a pumping mechanism P fibers suspended in a slurry are pumped through a normally circular conduit 10 into the device, generally indicated at 11.

Generally, the consistency of the fibers in the slurry is quite high, but it has been found by the use of this device that the consistency of the dispersion in the forming zone can be increased between 10–100 times that normally used to a consistency of about 0.2% to about 0.5%. Conduit 10 has an outflow end joined by conventional pipe connections to the entry end of the device 11. Adjacent the exit end of device 11 is a web former 12 onto which the fibers uniformly dispersed in device 11 will be delivered for formation into a non-woven web. Thus, it is apparent that the circular cross section of the fibers in a slurry will be transformed into a rectangular cross section as the fibers are delivered in a dispersion to the web former. Device 11 demonstrates a capacity for gradually and progressively converting a flow of circular cross section upon entry therein into a constantly widening and thinning stream which has assumed a flow of generally rectangular cross section upon discharge therefrom, it being understood that the widthwise dimension of the flow stream at the exit end of the device will correspond substantially to the lateral width of the web former.

Stated otherwise, the fiber slurry passes through conduit 10 from a source of supply and is transformed from its flow of circular cross section to a flow of ever-widening relatively flat cross section within device 11, all so as to contribute to the general purpose of precluding the development of non-uniform fiber dispersion at the web-forming region of the apparatus.

As shown in FIG. 1, device 11 includes a rigid-walled, laterally diverging channel 13 into which the slurry in conduit 10 is delivered and out of which the final fiber dispersion is delivered onto web former 12.

In channel 13 the flowing stream of slurry deepest at the point of slurry entry and becomes wider and shallower adjacent web former 12. Also, the channel is preferably covered with a series of baffles 14, which cover rolls disposed in the channel for the purpose of spreading and dispersing the slurry into a uniform fiber dispersion.

Figure 2:
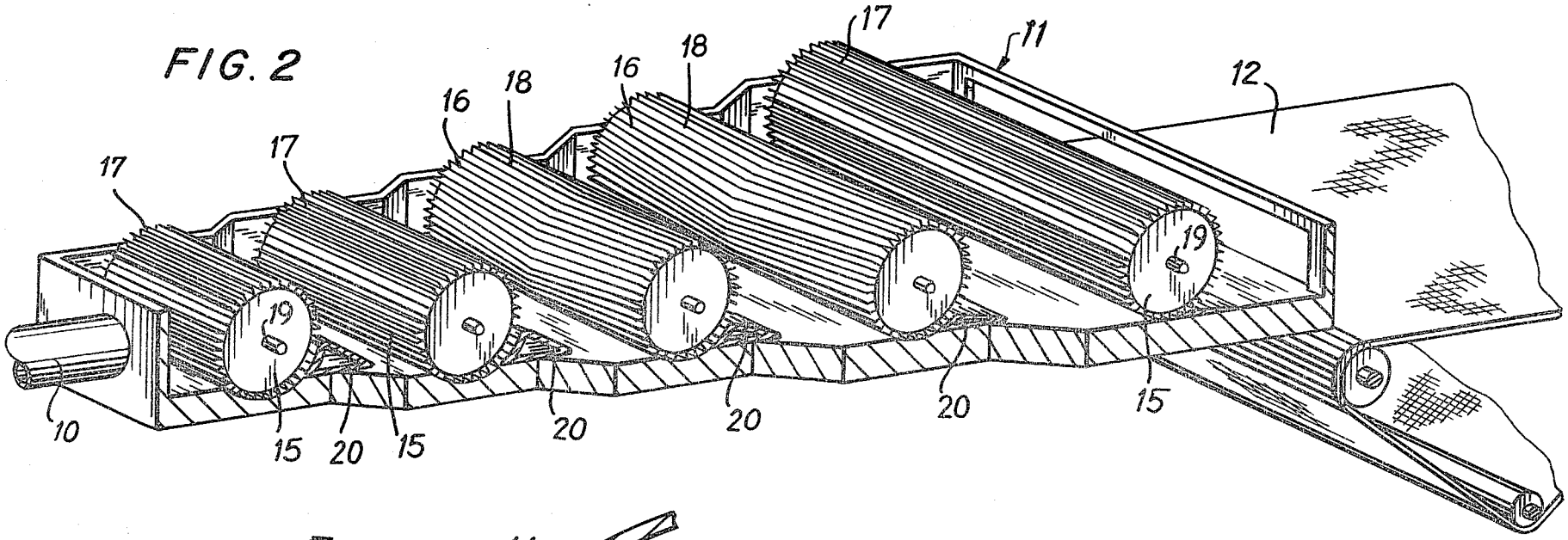
FIG. 2 is a view similar to FIG. 1, which view shows the top and side of the device of FIG. 1 cutaway.

As best shown in FIG. 2, the roll may be either dispersing rolls 15 or spreading rolls 16. The rolls generally keep the fibers suspended in a medium moving, eliminate flocking, segregation, and settling of the fibers, and destroy objectionable currents, so as to better prepare the dispersion for delivery onto the web former under uniform pressure and velocity conditions across the width of the former.

Basically, by such agitating units, the device provides means whereby the stream meets identical resistance across its entire width and is evenly fed to the web former at a single, selected velocity. Simultaneously therewith, specific prior art defects are eliminated, including the formation of light and heavy streaks running in the machine direction at regular or varying spaced intervals across the machine width by the creation of a pattern of a multiplicity of minute cross currents.

The rolls extend transversely of the path of the stream and are in a spaced relation to each other. A rotative movement is imparted to each roll by a power means, not shown. Preferably, the rolls are rotated in the same direction and in a timed relation to the rate of flow or at a varying rate of speed so that they are rotated either in unison or out of unison and at constant or at variable speeds.

Figure 3:
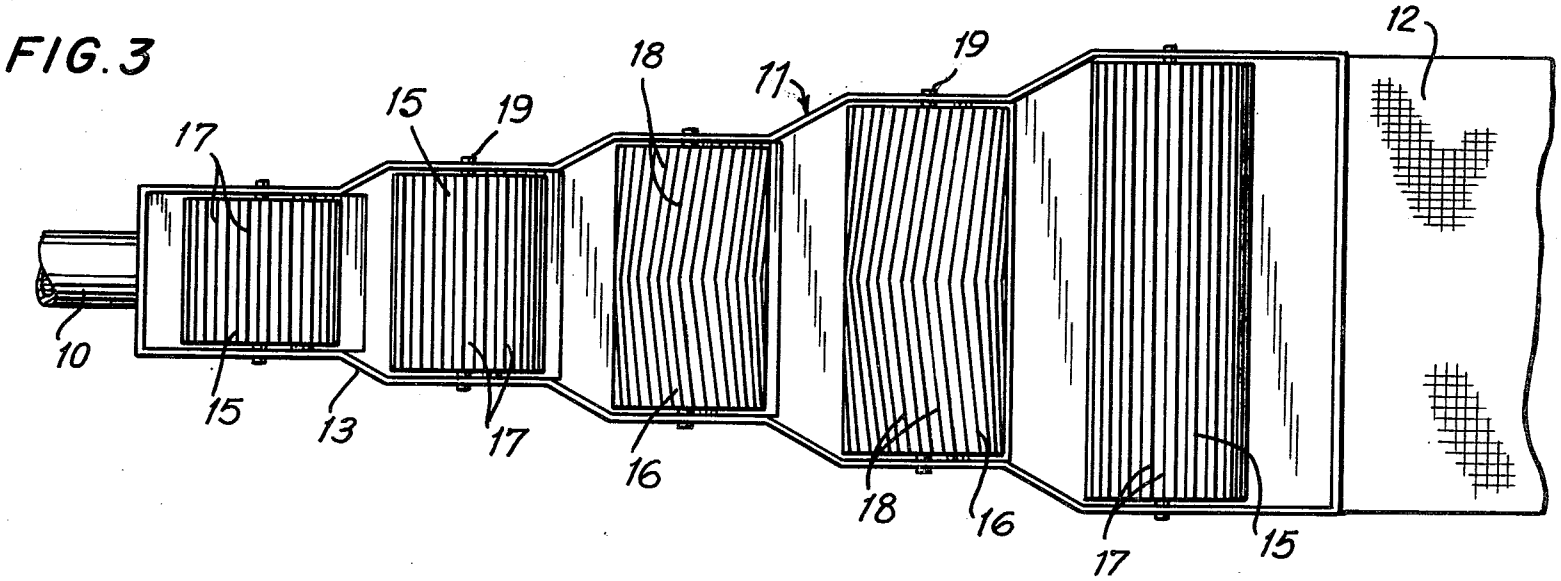
FIG. 3 is a schematic top view of the device shown in FIG. 2.
Figure 4:
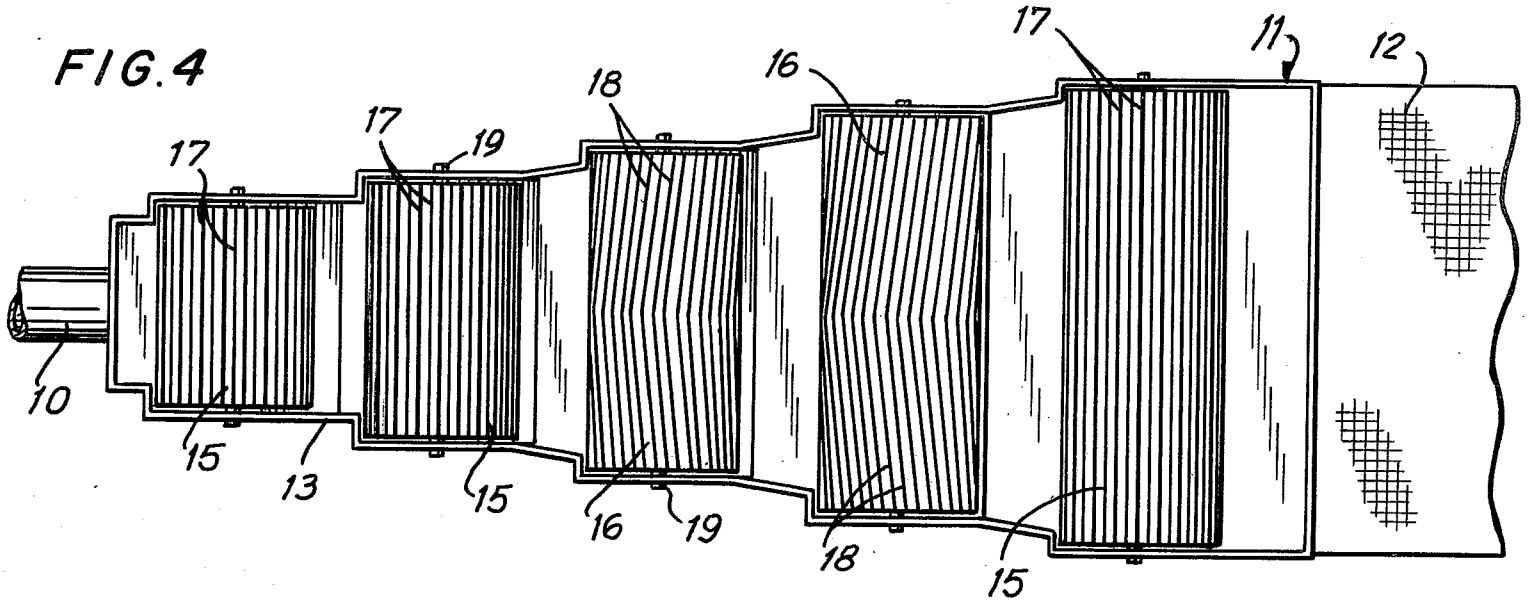
FIG. 4 is a schematic top view of another embodiment of the device shown in FIG. 2.

The rolls may be conventional Holander beater rolls and preferably the dispersing rolls 15 have transverse bars, which are indicated at 17 in FIGS. 3 and 4. Spreading rolls 16 preferably have transverse or divergent spiral wound bars, the latter of which are indicated by 18 in FIGS. 3 and 4. Again as best shown in FIGS. 3 and 4, rolls 15 and 16 are journaled in channel 13 for rotation by conventional means, indicated at 19.

Using rolls having a diameter of about 2 feet, the fibers in the slurry can be dispersed at about 100–150 rpm. Preferably, the bars of rolls 15 and 16, an example of which are indicated in FIG. 5, are about ¼ inch wide on ⅞ inch centers and the gap between two bars is about 1 inch in depth.

The device also includes means in cooperation with rolls 15 and 16 for moving the dispersion towards the exit end of channel 13 adjacent web former 12. The preferred means are backfalls 20, each of which are placed downstream of a roll, as shown in FIG. 2. The backfalls aid in dispersion of the fibers, provide a pumping action to move the dispersion, and generally maintain the desired velocity of the dispersion movement. Particularly, it is apparent from FIG. 2 that the backfall height decreases as the web former is approached, so that the dispersion velocity most closely approximates the velocity of the moving web former.

Operation of the device generally entails first dispersing the fibers in the slurry by rolls 15. Although rolls 15 and 16 somewhat each provide the dispersing or spreading function of the other, rolls 16 spread the dispersion to the sides of channel 13. While the fibers are being dispersed, they interlock in a three-dimensional network, particularly if they are the difficult to disperse fibers discussed above and these fibers are being dispersed in a high viscosity medium. The network comprises loosely entangled fibers and maintains its integrity as it moves in channel 13 towards web former 12. Thus, the rolls not only uniformly disperse the fibers, entangle the fibers into a three-dimensional network, and spread the network evenly across the channel, but also, in cooperation with backfalls 20, provide a means for a most efficient transfer of the fiber network to the web former, eliminating the destruction of the integrity of the network that would occur if a conventional head box were utilized.

Figure 5:
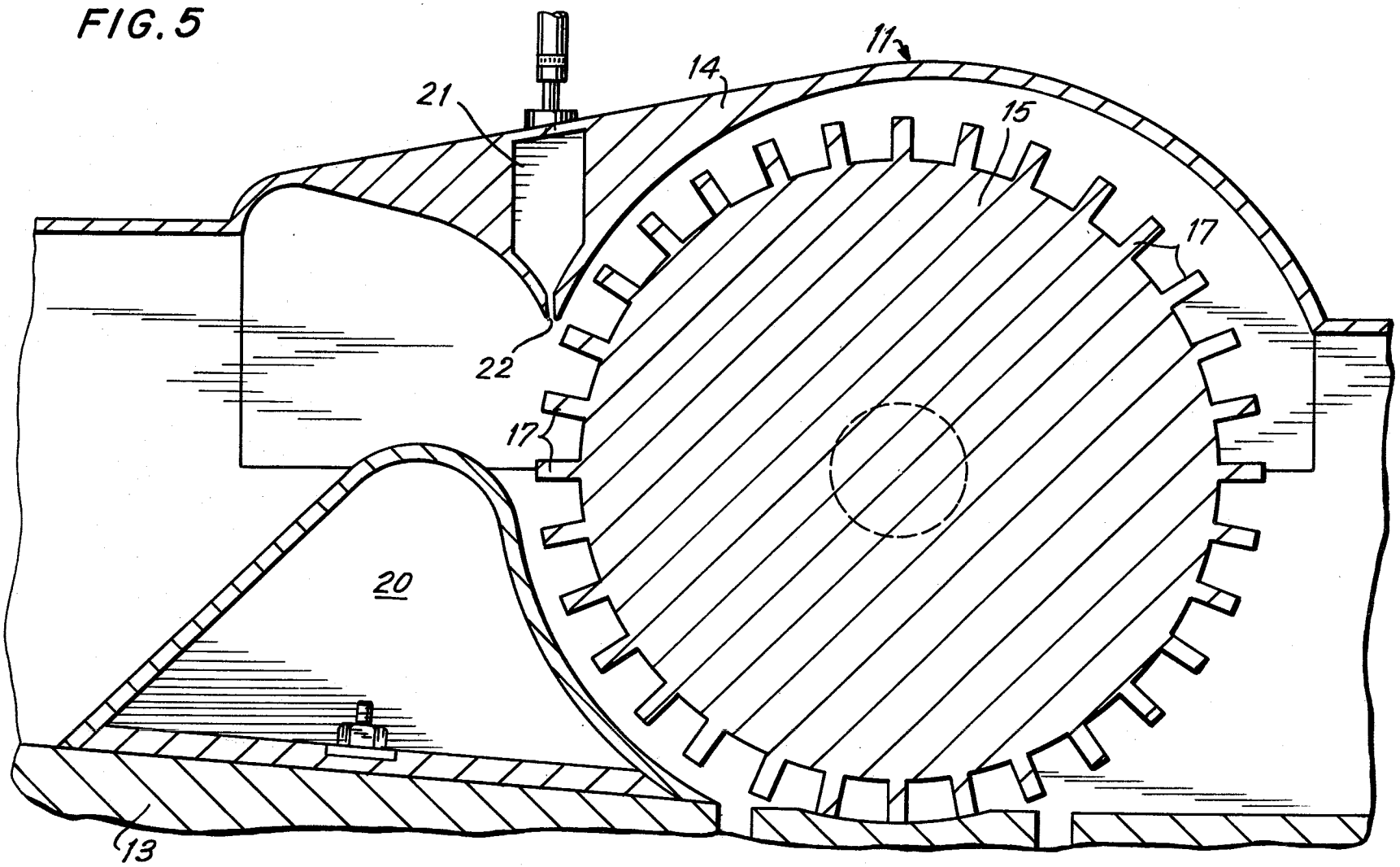
FIG. 5 is a cross sectional view of the device of FIG. 1 taken through lines 5—5 of FIG. 1.

Looking at FIG. 5, it is easier to understand how device 11 maintains the fibers uniformly dispersed while the dispersion moves towards web former 12.

From right to left the fibers dispersed in a medium move towards a downstream roll. In this case, the dispersion is picked up on bars 17 of roll 15. The bars further disperse and spread sideways the fibers. As the roll rotates, the dispersion is moved up one side of backfall 20. As the dispersion loses contact with bars 17, it rolls over and down the other side of backfall 20, so that essentially it is propelled forward although it is no longer in contact with a roll. Thus, the rolls and backfalls cooperate to maintain the fibers in dispersion and moving at a desired velocity, which velocity is effected by the selected height of the backfalls. Preferably, the rotation of the rolls and height of the backfalls is determined so that the forward velocity of the dispersion is equal to the linear speed of the web former.

Particularly with regard to long crimped fibers being dispersed in a high viscosity medium, the device of this invention is useful for maintaining the dispersion uniform and eliminating uneven entangling of the fibers, which creates knots in the fibers and therefore presents an uneven dispersion to the web former. However, knotting and uneven entanglement still occur to some degree, in a high viscosity medium, if the dispersion is allowed to follow over the top of a roll.

Follow over causes a decrease in the selected velocity of the dispersion and may effect the coaction between the fibers and the bars of a roll. Thus, means for insuring the complete separation of the dispersion from the roll is preferable.

The means most preferred for use in the device of the present invention are fluid doctors, one of which is shown in FIG. 5 and indicated as 21. The fluid doctor directs a fluid under pressure against the dispersion on the roll to clean the roll and prevent the formation of knots. The preferred fluid is air.

As apparent from FIG. 5, the dispersion contacts bars 17 when roll 15 is rotated in a clockwise direction and it is squeezed between the bars and one side of backfall 20. As the dispersion rotates above backfall 20, most of it will generally fall over the other side of the backfall and move towards the next roll or the web former, if the dispersion is at the exit end of channel 13.

However, when the fibers are dispersed in a high viscosity medium, some of the dispersion may cling to bars 17. By directing fluid through the orifice of a doctor 21 directly against roll 15, as shown in FIG. 5, this clinging dispersion will be scraped off the roll. One embodiment of a fluid doctor 21 useful in the device of this invention is shown in FIG. 5. The fluid doctor is generally disposed in the baffle 14 covering the roll so that it may direct fluid against the roll itself. With regard to the fluid doctor shown in FIG. 5, generally it is connected by conventional means to a source of fluid under pressure and has portions forming a slot 22 adjacent the roll through which fluid may be directed.

Figure 7:
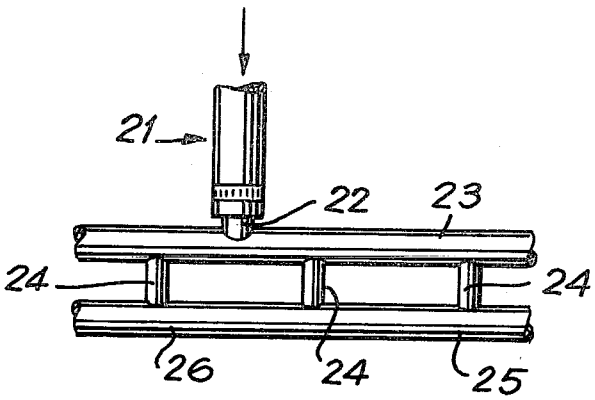
FIG. 7 is a front view of the portions of the device shown in FIG. 6 taken through lines 7—7 of FIG. 6.
Figure 6:
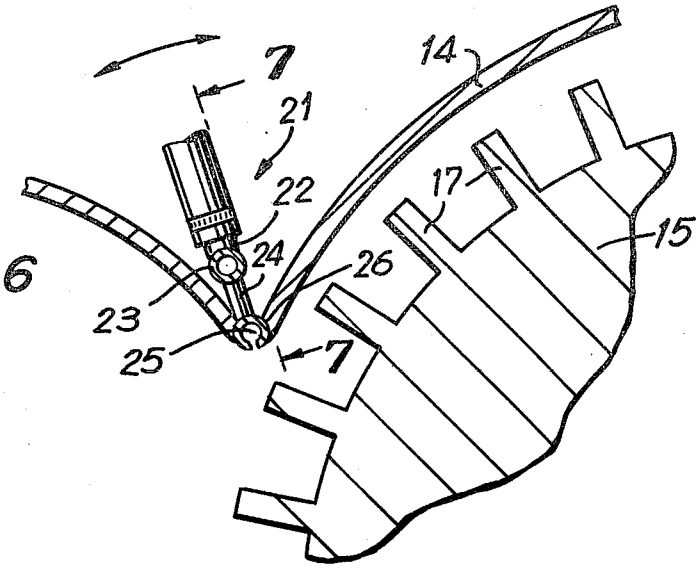
FIG. 6 is an alternate embodiment of portions of the device illustrated in FIG. 5.

Another embodiment of a fluid doctor 21 useful in the device of the present invention is shown in FIGS. 6 and 7. In this embodiment, fluid is first directed through a generally narrow tube 22, an elongated tube 23 branching off tube 22 and extending essentially perpendicular to tube 22, through various third tubes 24, through a slot 25 formed in a fourth tube 26, which fourth tube is parallel to tube 23, and against the roll to be scraped. By using a fluid doctor of this construction, the fluid being directed ultimately against the roll is evenly distributed along the width of the roll so as to produce an even scraping. Of course, fluid doctors of other construction can be utilized in the device of the present invention. As a modification of the fluid doctors shown in FIGS. 5–7, it is contemplated that these doctors may be made rotatable so as to direct a fluid at an angle different than that shown against the rolls.

Other modifications of the device of the present invention will be apparent to those skilled in the art in view of the above disclosure.

What is claimed is:

1. In an apparatus for forming a non-woven, fibrous web, a device for making a uniform density dispersion of the fibers in a fiber slurry and depositing the dispersion onto a web former, the device comprising a channel having a fiber slurry entry end and an exit end adjacent said web former, said channel being laterally divergent from its fiber slurry entry end to its fiber slurry exit end adjacent the web former;

means for supplying a flowing stream of fiber slurry to the fiber slurry entry end of said channel such that the greatest thickness of said stream of slurry is at said fiber entry end of said channel and said stream of slurry is wider and thinner at said fiber slurry exit end of said channel;

at least one first roll rotatably secured in the channel for uniformly dispersing the fibers in the fiber slurry;

at least one second roll rotatably secured in the channel for uniformly spreading the dispersed fibers throughout the channel; and means in cooperation with the rolls for moving the dispersion of fibers to said exit end of the channel adjacent the web former, whereby the dispersion is deposited onto the former.

2. The device of claim 1 wherein the channel is rigid-walled and is connected between a pump of the apparatus and the web former, the pump delivering the fiber slurry into the entry end of the channel.

3. The device of claim 1 wherein the first roll is a dispersing roll having transverse bars.

4. The device of claim 1 wherein the second roll is a spreading roll having transverse bars.

5. The device of claim 1 wherein the second roll is a spreading roll having divergent spiral wound bars.

6. The device of claim 1 further comprising baffles covering the rolls and attached to the channel, and fluid doctors disposed in the baffles and directed at the rolls for delivery of jets of fluid against the rolls to insure the separation of the fibers from each roll as the dispersion moves away from the roll.

7. The device of claim 1 wherein the means in cooperation with the rolls for moving the dispersion of fibers are backfalls, each one being placed downstream of a roll in the channel.

8. A process for uniformly dispersing long crimped fibers in a high viscosity medium and depositing the dispersion onto a web former as a uniformly dispersed, three-dimensional network of loosely entangled fibers, the process comprising delivering the fibers, having a length of about 2 inches, in a fiber/medium slurry as a flowing stream into a laterally divergent channel, the greatest thickness of said stream of slurry being at the slurry entry end of said channel and said stream of slurry being wider and thinner adjacent the slurry exit end of said channel;

contacting the slurry with at least one first rotating roll rotatably secured in the channel for uniformly dispersing the fibers;

contacting the dispersed fibers with at least one second rotating roll rotatably secured in the channel for uniformly spreading the dispersed fibers throughout the channel;

moving the dispersion to the exit end of the channel; and depositing the dispersion onto the web former.

* * * * *